US009044950B2

(12) United States Patent
Sato et al.

(10) Patent No.: US 9,044,950 B2
(45) Date of Patent: Jun. 2, 2015

(54) PRINTING APPARATUS AND PRINTING METHOD

(71) Applicant: Seiko Epson Corporation, Tokyo (JP)

(72) Inventors: Akito Sato, Nagano-ken (JP); Satoshi Yamazaki, Nagano-ken (JP); Keiko Yamada, Nagano-ken (JP); Yuko Yamamoto, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 4 days.

(21) Appl. No.: 14/078,082

(22) Filed: Nov. 12, 2013

(65) Prior Publication Data

US 2014/0152730 A1 Jun. 5, 2014

(30) Foreign Application Priority Data

Nov. 30, 2012 (JP) ..... 2012-262118

(51) Int. Cl.

| | |
|---|---|
| ***B41J 29/38*** | (2006.01) |
| ***B41J 2/165*** | (2006.01) |
| ***B41J 2/17*** | (2006.01) |
| ***B41J 2/21*** | (2006.01) |

(52) U.S. Cl.

CPC ..... *B41J 2/16526* (2013.01); *B41J 2/1714* (2013.01); *B41J 2/2146* (2013.01)

(58) Field of Classification Search

CPC ..... B41J 29/38; B41J 2/0458; B41J 2/04563; B41J 29/393; B41J 2/04591; B41J 2/04581

See application file for complete search history.

(56) References Cited

U.S. PATENT DOCUMENTS

| | | | | |
|---|---|---|---|---|
| 7,571,969 | B2 * | 8/2009 | Kusunoki et al. | 347/9 |
| 8,310,721 | B2 * | 11/2012 | Saita et al. | 358/1.9 |
| 2011/0234662 | A1 | 9/2011 | Tsuchiya | |
| 2012/0194606 | A1 | 8/2012 | Shinoda | |

FOREIGN PATENT DOCUMENTS

| | | |
|---|---|---|
| JP | 2010-137388 | 6/2010 |
| JP | 2012-153151 | 8/2012 |
| JP | 2012-158070 | 8/2012 |

* cited by examiner

*Primary Examiner* — Manish S Shah
*Assistant Examiner* — Jeremy Delozier

(57) ABSTRACT

A printing apparatus that includes a head unit in which a plurality of heads are disposed so that parts of nozzle rows overlap with each other between the heads and a control unit configured to make the head unit execute a specified operation for forming flushing dots other than image formation dots on a print medium by discharging liquid through the nozzles. The control unit makes the head unit execute the specified operation in which a liquid amount discharged in the specified operation per nozzle that does not belong to an overlap area where parts of the nozzle rows overlap with each other between the heads is larger in a set movement distance thereof than a liquid amount discharged in the specified operation per nozzle that belongs to the overlap area in a set movement distance thereof, if a specified condition for execution of the specified operation is satisfied.

6 Claims, 10 Drawing Sheets

PRINTING APPARATUS AND PRINTING METHOD

BACKGROUND

1. Technical Field

The present invention relates to printing apparatuses and printing methods.

2. Related Art

Such a printer is widely known that includes a printing head called a line head in which a row of nozzles whose length is approximately equal to the width of a print medium is provided, and serves as an ink jet printer configured to perform printing by discharging ink through a plurality of nozzles. There is provided a line head which is constructed by serially connecting a plurality of heads each of which is shorter than the entire length of the line head in one direction (longitudinal direction of the line head). In the case where the above configuration is employed, the heads are connected so that an end portion of one head and an end portion of another head are intentionally overlapped each other in the longitudinal direction of the line head while taking into consideration an attachment error at a connecting portion of the heads.

A density of nozzles at the connecting portion is locally higher than that at another portion other than the connecting portion in the line head. Accordingly, in order to prevent deterioration in image quality when discharged results by the heads overlap with each other at the positions corresponding to the connecting portion on a print medium, it has been carried out to control the amount of ink discharged through the nozzle in the vicinity of the end portion of each head to decrease in a gradational manner as the position of the nozzle is closer to the end portion of the head, or the like.

Meanwhile, in an ink jet printer, if such a state continues that ink is not discharged through the nozzles, moisture of the ink evaporates through the openings of the nozzles so that viscosity of the ink increases in some case. If the viscosity of ink increases, the nozzles are clogged and so on, consequently ink discharge operation becomes unstable in some case. In order to prevent the occurrence of such problem, it is preferable that what is called "flushing" be performed to prevent or solve the clogging of the nozzles. Flushing is a process in which ink is forcibly discharged through the nozzles.

As a related technique, well-known is an image forming apparatus that includes a recording head (line head) in which a plurality of heads each having a plurality of nozzles arranged therein for discharging droplets are aligned in a staggered manner in a nozzle arrangement direction, and in which the nozzles at the end portions of the heads overlap each other in the nozzle arrangement direction; the image forming apparatus performs a non-printing discharge (flushing) of droplets through the overlapped nozzles in the heads onto a transport belt configured to transport paper, and performs another non-printing discharge of droplets onto paper through the nozzles which are not concerned with the non-printing discharge onto the transport belt (see JP-A-2010-137388). Note that the non-printing discharge does not contribute to image formation.

Since flushing is performed to prevent the nozzles from being clogged and so on, each nozzle need perform a certain amount of flushing whether the nozzle belongs to the connecting portion or not. Accordingly, in the case where the above-described control operation is performed on the flushing in which the amount of ink discharge through the nozzle in the vicinity of the end portion of the head is decreased in a gradational manner as the position of the nozzle is closer to the end portion of the head, such a risk can arise that there exist some nozzles through which necessary and sufficient flushing is not performed.

Meanwhile, in the case where flushing is performed through the nozzles in a uniformed manner whether the nozzles belong to the connecting portion or not, when the flushing results by the heads that belong to the connecting portion overlap with each other on a print medium, stripe-shaped unevenness or the like is visually recognized in comparison with other area on the print medium. This can lead to a risk of occurrence of deterioration in image quality. Further, in JP-A-2010-137388, since flushing is performed through the overlapped nozzles (the nozzles belonging to the connecting portion) onto the transport belt, throughput of the printing is lowered. In addition, it has been needed to surely prevent the deterioration in image quality, which can occur due to the presence of the connecting portions.

SUMMARY

An advantage of some aspects of the invention is to provide a technique that is capable of performing necessary flushing, preventing deterioration in image quality, and also preventing a decrease in throughput of printing. It is also an advantage of some aspects of the invention to provide a technique that is capable of surely preventing the deterioration in image quality, which can occur due to the presence of the connecting portions.

A printing apparatus according to an aspect of the invention is a printing apparatus that includes a plurality of nozzles through which liquid is discharged and is capable of forming image formation dots to print an image specified as a print target by discharging the liquid; the printing apparatus includes a head unit in which disposed are a plurality of heads each including a plurality of nozzles and each head also includes a nozzle row where the plurality of nozzles are arranged in a direction intersecting with a direction in which a position of a print medium and a position of the head unit are relatively changed by movement of at least one of the print medium and the head unit, further the plurality of heads are disposed so that there is provided an overlap area where a position of parts of the above nozzle rows in the intersecting direction overlap with each other; the printing apparatus also includes a control unit configured to make the head unit execute a specified operation for forming flushing dots other than the image formation dots on the print medium by discharging liquid through the nozzles. In the printing apparatus, the control unit makes the head unit execute the above-mentioned specified operation in which a liquid amount discharged in the specified operation per nozzle that does not belong to an overlap area where parts of the nozzle rows overlap with each other between the heads is larger in a set movement distance thereof than a liquid amount discharged in the specified operation per nozzle that belongs to the overlap area in a set movement distance thereof, in the case where a specified condition for execution of the specified operation is satisfied.

According to this configuration, in the case where the specified condition is satisfied, a liquid amount discharged in the specified operation (flushing) per nozzle that does not belong to the overlap area (connecting portion) is larger in a set movement distance thereof than a liquid amount discharged in the flushing per nozzle that belongs to the overlap area in a set movement distance thereof. Through this, a difference in visibility of the flushing dots on a print medium between a portion where the flushing dots are formed through the nozzles belonging to the overlap area and a portion where the flushing dots are formed through the nozzles not belonging to the overlap area is removed, thereby suppressing generation of the above-mentioned stripe-shaped unevenness (image quality deterioration). Moreover, because a forming amount of the flushing dots discharged through the nozzles belonging to the overlap area is not reduced, it is possible with certainty to prevent or remove the clogging of the nozzles which can occur when flushing is not performed sufficiently. In addition, unlike JP-A-2010-137388, because flushing is not performed onto a transport belt, it is possible to prevent the throughput of printing from being lowered.

According to an aspect of the invention, it is preferable for the control unit to determine that the specified condition is satisfied in the case where a liquid amount discharged in the specified operation per nozzle in a set movement distance thereof is to be equal to or greater than a predetermined liquid amount threshold value.

According to this configuration, the above-mentioned difference in visibility, which is likely to occur when the liquid amount discharged by flushing per nozzle in a set movement distance thereof is large to some extent, can be removed with certainty.

According to an aspect of the invention, it is preferable for the printing apparatus to include a temperature/humidity detector configured to detect an ambient temperature and/or humidity, and for the control unit to make a liquid amount discharged in the specified operation per nozzle in a set movement distance thereof be equal to or greater than the predetermined liquid amount threshold value in the case where the temperature/humidity detector has detected a vale of temperature equal to or greater than a predetermined temperature threshold value and/or a value of humidity equal to or less than a predetermined humidity threshold value.

In the case where a temperature equal to or greater than the predetermined temperature threshold value and/or humidity equal to or less than the predetermined humidity threshold value, much more flushing is performed at each nozzle in order to prevent or remove the clogging of the nozzle. In such state, the difference in visibility of the flushing dots is likely to be expanded. However, by employing the above configuration, the difference in visibility will be removed and the generation of stripe-shaped unevenness (image quality deterioration) will be suppressed.

According to an aspect of the invention, it is preferable for the printing apparatus to include a humidification liquid tank for storing a humidification liquid containing a nonvolatile component and a humidified air supplier for supplying a humidified air having been humidified by the humidification liquid stored in the humidification liquid tank to a sealed space that opposes an opening of the nozzle, and for the control unit to make a liquid amount discharged in the specified operation per nozzle in a set movement distance thereof be equal to or greater than the predetermined liquid amount threshold value in the case where a humidification function of the humidified air supplier has declined below a predetermined standard level.

In the case where the humidification function of the humidified air supplier has declined below the predetermined standard level, much more flushing is performed at each nozzle in order to prevent or remove the clogging of the nozzle. In such state, the difference in visibility of the flushing dots is likely to be expanded. However, by employing the above configuration, the difference in visibility will be removed and the generation of stripe-shaped unevenness (image quality deterioration) will be suppressed.

It is preferable for the control unit to judge whether or not an amount of the nonvolatile component in the humidification liquid that is stored in the humidification liquid tank is equal to or greater than a defined value, and determine that the humidification function of the humidified air supplier has declined below the predetermined standard level in the case where the amount of the nonvolatile component is equal to or greater than the defined value.

A printing apparatus according to another aspect of the invention is a printing apparatus that includes a plurality of nozzles through which liquid is discharged and is capable of forming an image specified as a print target by discharging the liquid; the printing apparatus includes a first head unit in which disposed are a plurality of first heads each having a plurality of first nozzles for discharging a first liquid therethrough to form the image on a print medium and each first head also has a nozzle row where the plurality of first nozzles are arranged in a direction intersecting with a direction in which a position of the print medium and positions of the first head unit and a second head unit are relatively changed by movement of at least one of the print medium and the first and second head units, further the plurality of first heads are disposed so that parts of the above nozzle rows overlap with each other between the first heads in the intersecting direction; the printing apparatus also includes the second head unit having a nozzle row where there are arranged, in the above intersecting direction, a plurality of second nozzles through which a second liquid that acts on the first liquid to aggregate or precipitate a component within the first liquid is discharged; and the printing apparatus further includes a control unit that controls the first head unit and the second head unit to discharge the first liquid through the first nozzles and the second liquid through the second nozzles. In the printing apparatus, the control unit is configured so that an amount of the second liquid per unit area discharged through the second nozzles onto a first region on the print medium onto which the first liquid is discharged through the first nozzles that belong to an overlap area where parts of the nozzle rows overlap with each other between the first heads is smaller than an amount of the second liquid per unit area discharged through the second nozzles onto a second region on the print medium onto which the first liquid is discharged through the first nozzles that do not belong to the overlap area.

According to this configuration, the amount of the second liquid discharged onto the first region is smaller than the amount of the second liquid discharged onto the second region. This removes a difference in degree of coloring or bleeding of the first liquid on a print medium between a portion where the first liquid has been discharged through the nozzles belonging to the overlap area and a portion where the first liquid has been discharged through the nozzles not belonging to the overlap area. Therefore, it is possible with certainty to prevent at least one serious effect of image quality deterioration which can occur due to the presence of the connecting portions.

The technical spirit according to this invention is realized not only in the form of a printing apparatus, but may be embodied in other products (apparatuses). Moreover, an invention of a method including a process that corresponds to the features of the printing apparatus according to any one of the above aspects (printing method), an invention of a print control program that makes a predetermined hardware system (computer) execute the above method, an invention of a computer-readable recording medium that stores the above program, and so on can be comprehended. The printing apparatus may be realized by a single apparatus (a printer having a liquid discharge function) or a plurality of apparatuses being combined together.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the drawings.

1. Overview of Apparatus

Figure 1:
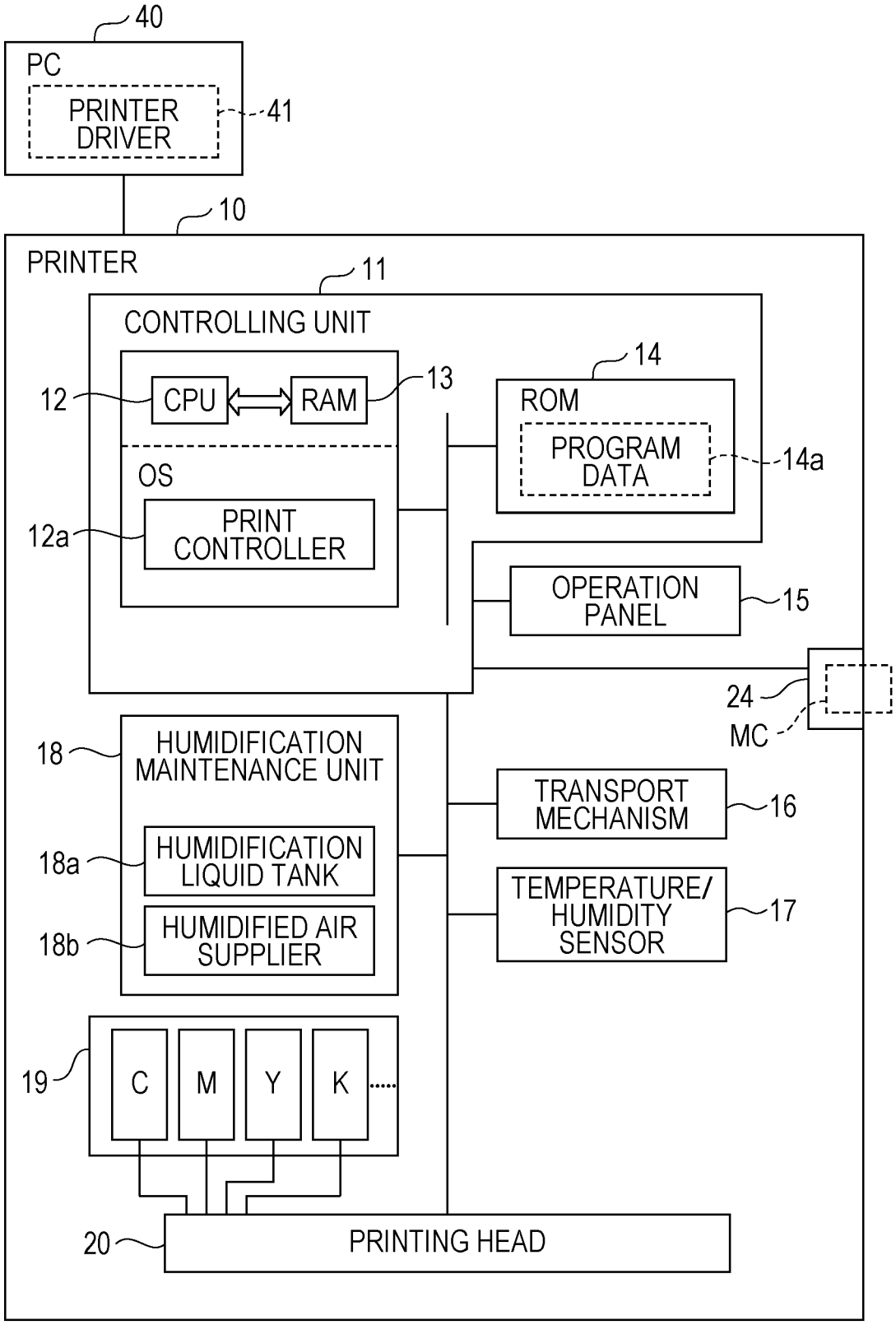
FIG. 1 is a diagram schematically illustrating a hardware configuration and a software configuration.

FIG. 1 schematically illustrates a hardware configuration and a software configuration according to this embodiment. In FIG. 1, a personal computer (PC) 40 and a printer 10 are illustrated. The printer 10 corresponds to a printing apparatus. Alternatively, a system including the PC 40 and the printer 10 may be taken as a printing apparatus. The printer 10 includes a controlling unit 11 for controlling a liquid discharge process (print process). In the controlling unit 11, a CPU 12 loads a program data 14*a* stored in a memory such as a ROM 14 into a RAM 13 and performs computing in accordance with the program data 14*a* under control of an OS, whereby firmware configured to control the apparatus is executed. The firmware is a program (print control program) which makes the CPU 12 execute the functions of a print controller 12*a* and the like.

The print controller 12*a* receives image data from, for example, storage media or the like inserted into the PC 40 or the printer 10 from exterior so as to create print data from the image data. Then, printing based on the print data can be carried out. The storage media inserted into the printer 10 from exterior can be a memory card MC, for example, and the memory card MC is inserted into a slot 24 formed in a housing of the printer 10. In addition, the print controller 12*a* can receive image data from various kinds of external devices such as a scanner, a digital still camera, a cellular phone that are wired or wireless connected to the printer 10, and servers or the like connected to the printer 10 via networks. The image data represents an image that a user arbitrarily specifies as a print target (print target image). The image data is, for example, bit map data such as RGB data including tones of a color system of red, green, and blue (R, G, B) for each pixel, ink amount data including tones of an ink color system (cyan (C), magenta (M), yellow (Y), black (K), and so on) used by the printer 10 for each pixel, or the like. The print controller 12*a* performs resolution conversion processing, color system conversion processing (color conversion processing), half-tone processing, and the like on the bit map data so as to create print data. The print data is data of each ink type in which a liquid (ink) discharge (dot-on) or non-discharge (dot-off) is defined for each pixel, for example.

Moreover, the print controller 12*a* can receive, from the PC 40, print data created from the image data by a printer driver 41 installed in the PC 40 and carry out printing based on the received print data. Alternatively, the print controller 12*a* can receive PDL data described in a predetermined Page Description Language (PDL) from the printer driver 41 and carry out printing of a print target image based on the PLD data. In this case, the print controller 12*a* analyzes the PDL data to convert it to an intermediate code, and then develops the intermediate code to create the bit map data as described earlier on the RAM 13. The print controller 12*a* creates the print data as described above from the bit map data.

A plurality of cartridges 19 each provided to each different liquid type are mounted in the printer 10. In the example in FIG. 1, the cartridges 19 corresponding respectively to inks of CMYK are mounted. Note that specific types of liquid and the number thereof used by the printer 10 are not limited to those described above, and the following can be used: that is, for example, various types of ink such as inks of light cyan, light magenta, orange, green, gray, light gray, white, metallic ink, and so on; precoat liquid for aggregating or precipitating a coloring component of each ink; and the like. Further, the printer 10 includes a printing head 20 configured to discharge (eject) liquid supplied from the respective cartridges 19 through a plurality of liquid discharge nozzles. The printing head 20 is what is called a line head having an elongated shape.

The print controller 12*a* generates driving signals for driving the printing head 20, a transport mechanism 16, and the like based on the print data. In the printing head 20, piezoelectric elements are respectively provided to nozzles 22 (see FIG. 3) so as to make droplets (dots) be discharged through the nozzles 22. The piezoelectric element deforms when the driving signal is applied thereto, and makes a dot be discharged through the corresponding nozzle 22. The transport mechanism 16 includes a motor (not shown), rollers 16*a*, 16*b*, 16*c* rotated by the motor (see FIG. 2), and the like, and transports a print medium along a predetermined transport direction by being drive-controlled by the print controller 12*a*. When ink is discharged through the nozzles 22 of the printing head 20, the dots adhere to the print medium which is being transported, whereby a print target image is reproduced on the print medium in accordance with the print data.

The printer 10 further includes an operation panel 15. The operation panel 15 includes a display unit (for example, a liquid crystal panel), a touch panel formed inside the display unit, and various types of buttons and keys, and receives input from a user, displays a necessary user interface (UI) screen on the display unit, and so on. Further, the printer 10 may include a temperature/humidity sensor 17 and a humidification maintenance unit 18.

Figure 2:
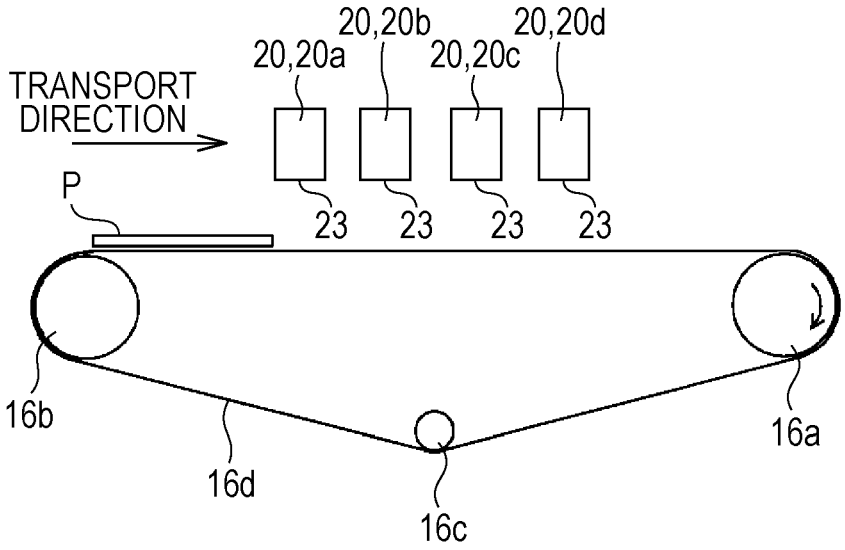
FIG. 2 is a diagram illustrating in a simplified manner an example of part of the internal configuration of a printer.

FIG. 2 illustrates in a simplified manner an example of part of the internal configuration of the printer 10 from a point of view facing to a longitudinal direction of the printing head 20.

Figure 3:
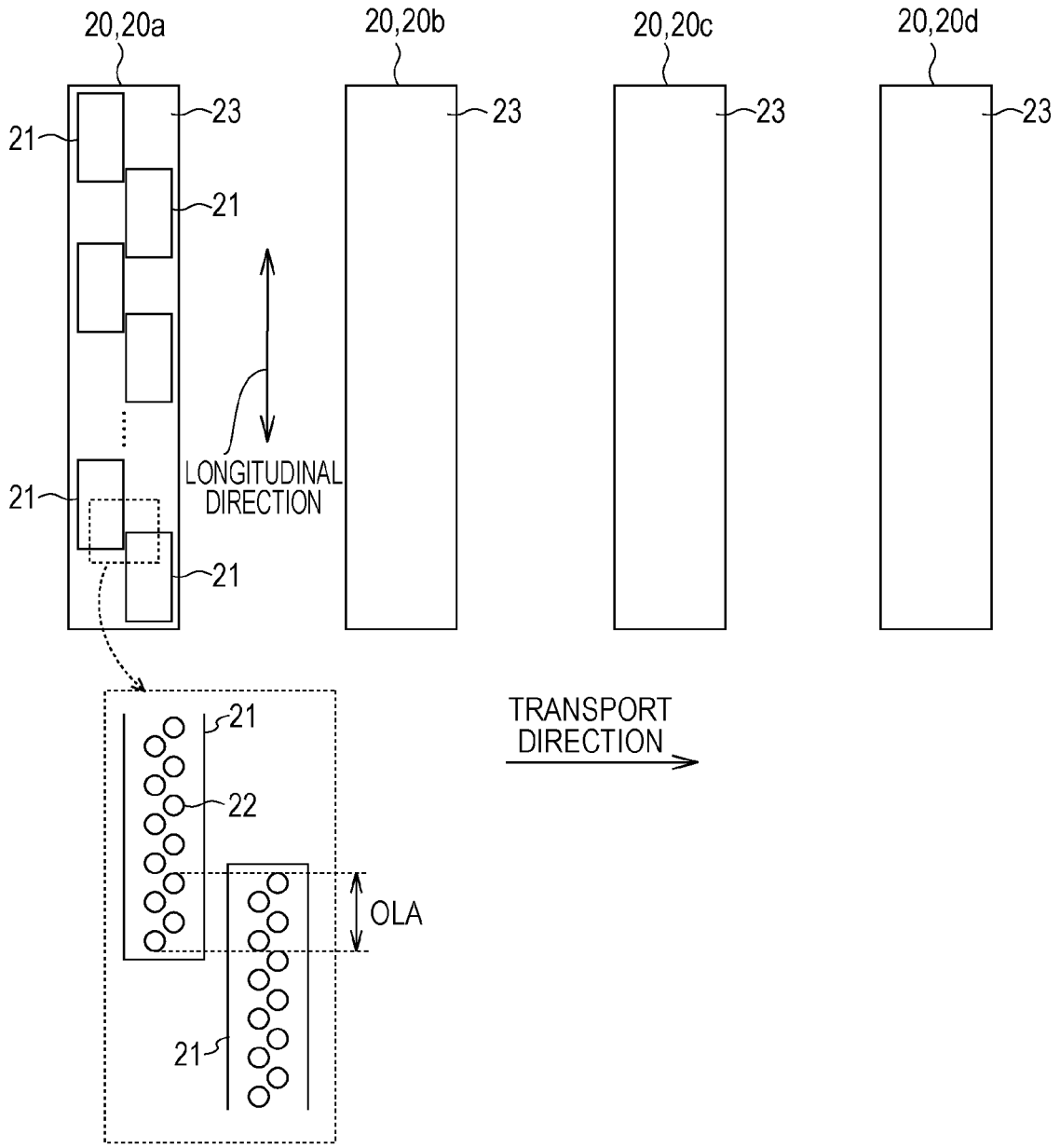
FIG. 3 is a diagram illustrating in a simplified manner an example of a printing head when viewed from a nozzle opening surface side.

FIG. 3 illustrates in a simplified manner an example of the printing head 20 when viewed from the side of a nozzle opening surface 23 (surface in which the openings of the nozzles 22 are formed).

The printing head 20 includes a plurality of line heads 20*a*, 20*b*, 20*c* and 20*d* each corresponding to each different ink type. The line heads 20*a*, 20*b*, 20*c* and 20*d* all have the same structure. For example, the line head 20*a* can discharge C ink, the line head 20*b* can discharge M ink, the line head 20*c* can discharge Y ink, and the line head 20*d* can discharge K ink, respectively. The line heads 20*a*, 20*b*, 20*c* and 20*d* are anchored, for example, to predetermined positions inside the printer 10 with the longitudinal directions thereof being parallel to each other. Hereinafter, unless otherwise designated, a "longitudinal direction" exclusively refers to a longitudinal direction of each of the line heads 20*a*, 20*b*, 20*c* and 20*d*.

As shown in FIG. 2, an endless belt 16*d* is provided at a position opposing the nozzle opening surface 23, and is moved while being stretched and wound upon the rollers 16*a*, 16*b* and 16*c* that rotate serving as part of the transport mechanism 16. A print medium P is placed on the endless belt 16*d* to be transported in the transport direction and receives ink discharged through the nozzle 22 when the medium passes under the nozzle opening surface 23. The line heads 20*a*, 20*b*, 20*c* and 20*d* take a direction that intersects with the transport direction of the print medium P as the longitudinal direction, and are disposed at a set interval in the transport direction. Note that "to intersect" means "to meet at right angles" in this case. However, "right angle" in this specification means not only a precise angle (just 90 degrees) but also an angle of approximately 90 degrees within an acceptable error range from a quality standpoint of the apparatus.

In this embodiment, principally, descriptions are given on the premise that the apparatus employs a configuration in which the printing head 20 is fixed while a print medium is transported by the transport mechanism 16. However, such a configuration can be also employed that the printing head 20 is moved by a carriage relative to a print medium that does not move (or movement thereof is temporarily stopped). In other words, any configuration can be employed as long as at least one of the print medium and the printing heads 20 moves so as to relatively change the positions of the print medium and the printing head 20 along a set direction. In the case where the printing head 20 moves, a direction that intersects with the direction in which the positions of the print medium and the printing head 20 are relatively changed (the set direction mentioned above) is taken as the above-discussed longitudinal direction. In this respect, a "movement distance" described in the aspects of the invention and in this specification refers to an amount of positional change between the print medium and the printing head 22 in the set direction.

As shown in FIG. 3, a single line head (the line head 20*a* is exemplified in FIG. 3) is configured by disposing a plurality of heads 21 each of which is shorter than the entire length of the line head. Each of the heads 21 includes a nozzle row in which the plurality of nozzles 22 are arranged in the longitudinal direction. A nozzle density of the nozzle row in the longitudinal direction (the number of nozzles per inch) is equal to print resolution (dpi) in the longitudinal direction. The line head is configured by disposing the heads 21 (in a staggered manner) so that parts of the nozzle rows overlap each other between the heads 21 in the longitudinal direction. Accordingly, a single line head can be called a head unit including the plurality of heads 21. In addition, in FIG. 3, a connecting portion of the head 21 in the nozzle opening surface 23 is exemplified in a range outlined by a dotted line. According to this example, one head 21 and the other head 21 in the connecting portion overlap each other so that several nozzles 22 at an end portion of the one head 21 and several nozzles of at an end portion of the other head 22 match in positions in the longitudinal direction. Hereinafter, an area in which the heads 21 overlap each other in the above manner is referred to as an overlap area (OLA).

In this embodiment, the printer 10 is capable of performing flushing. Flushing is a specified operation that forms dots other than dots for printing a print target image specified arbitrarily by a user as a print target, by discharging ink through the nozzles 22. The dots for printing a print target image can be called image formation dots, while the dots other than the image formation dots can be called flushing dots.

2. Flushing Control Process

Figure 4:
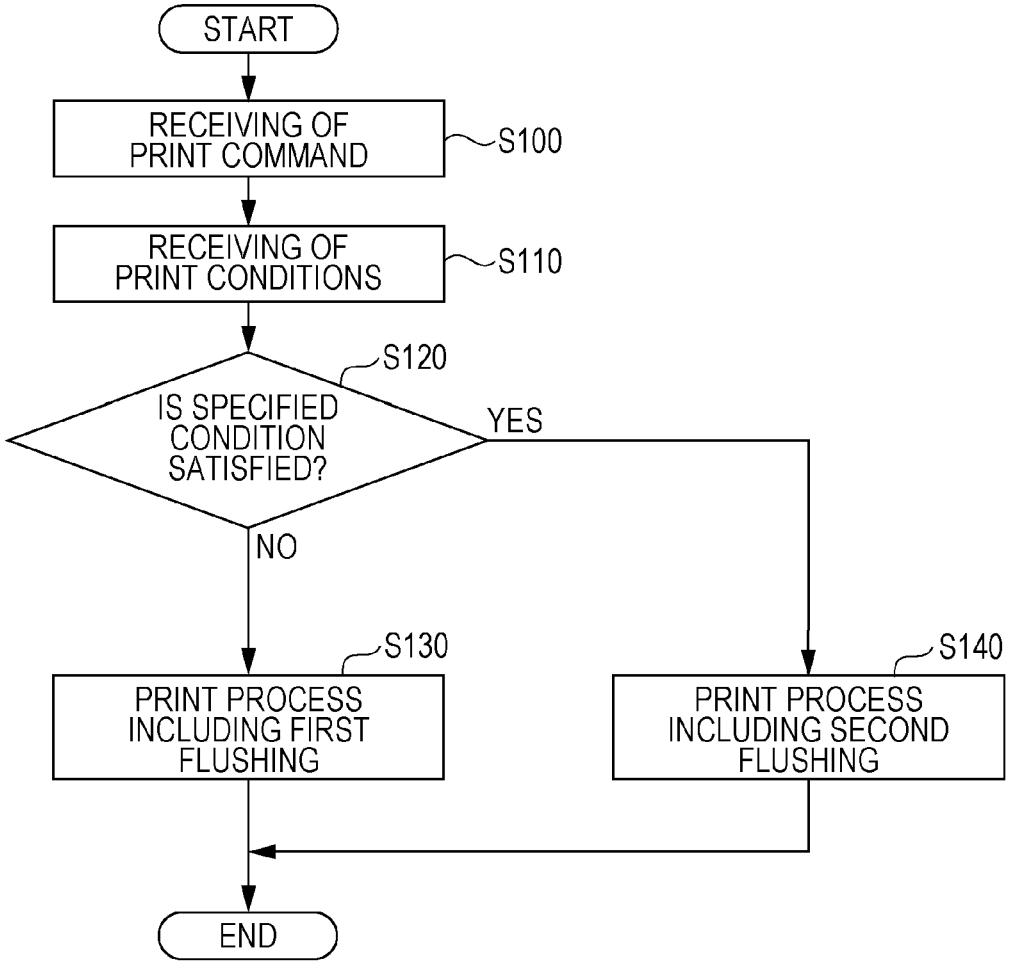
FIG. 4 is a flowchart illustrating a flushing control process.

FIG. 4 illustrates, in the form of a flowchart, a flushing control process which is executed under the above-discussed configuration. Here, the flushing control process includes a process in which a forming amount of flushing dots is or is not varied depending the nozzles 22, and is executed basically in combination with the print process of a print target image in accordance with the print data. Since the print process of a print target image has already been described, detailed description thereof will be appropriately omitted hereinafter.

In step S100, the print controller 12*a* receives a print command for a print target image from a user via the operation panel 15. In other words, the user operates the operation panel 15 to arbitrarily select a print target image via a UI screen displayed in the display unit, and instructs the printer 10 to print the print target image. Through this, image data representing the print target image is acquired from optional information sources such as the PC 40, the storage media, the external devices, and so on, as described before. It is needless to say that a user can instruct the printer 10 to print a print target image from exterior using a mobile terminal or the like with which the user can remotely operate the printer 10.

In step S110, the print controller 12*a* receives print conditions for the printing of the print target image in accordance with user input via the operation panel 15 (or the above-mentioned mobile terminal or the like capable of remotely operating the printer 10). As the print conditions, for example, various kinds of conditions can be received such as a type and size of a print medium, print orientation, print assignment to a print medium, print resolution, setting of a single-sided print or a double-sided print, and so on. It is also possible for a user to cause the printer 10 to print a print target image by using the PC 40. That is, the printer 10 receives the print data, the PDL data, and the like from the printer driver 41 in some case in the manner described above. In this case, the user inputs a print command for a print target image and print conditions via a UI screen proposed and displayed by the printer driver 41 on a display unit of the PC 40. Further, the information indicating the print conditions inputted in this manner is transmitted from the PC 40 side to the printer 10 together with the print data and PDL data. Accordingly, in the case where the information on the print conditions has been transmitted from the PC 40 side together with the print data and PDL data, it is considered that steps S100 and S110 have been executed upon the print controller 12*a* having acquired the transmitted information and data.

In step S120, the print controller 12*a* determines whether or not a specified condition for execution of the flushing is satisfied. If the specified condition is not satisfied ("No" in step S120), the process proceeds to step S130; if the specified condition is satisfied ("Yes" in step S120), the process proceeds to step S140. The meaning of "specified condition" will be described in detail later.

In step S130, the print controller 12*a* executes the print process of the print target image including a "first flushing". In the first flushing, an ink amount discharged per set movement distance through each of the nozzles 22 included in the printing head 20 is basically the same across all the nozzles 22. In other words, the number of flushing dots discharged per set transport distance of the print medium through each of the nozzles 22 and an ink amount per flushing dot are common to all the nozzles 22. The printer 10 is capable of discharging a plurality of different types of dots through the ink nozzles 22. Those different types of dots are called, for example, a small dot, a middle dot, and a large dot, and an ink amount of each dot type (weight, volume, or the like per droplet) differs from each other. Therefore, basically in the first flushing, the same dot type (small dot, for example) is discharged through each of the nozzles 22. In step S130, the print controller 12*a* virtually creates flushing data, for example, in which the flushing data has the same number of pixels as the print target image in the vertical and horizontal directions, or the flushing data has the number of pixels corresponding to the size of the print medium in the vertical and horizontal directions. The flushing data is such data that represents dot patterns for causing a number of flushing dots to be formed in all pixel rows in parallel to the transport direction (hereinafter, simply called "pixel rows").

Figure 5:
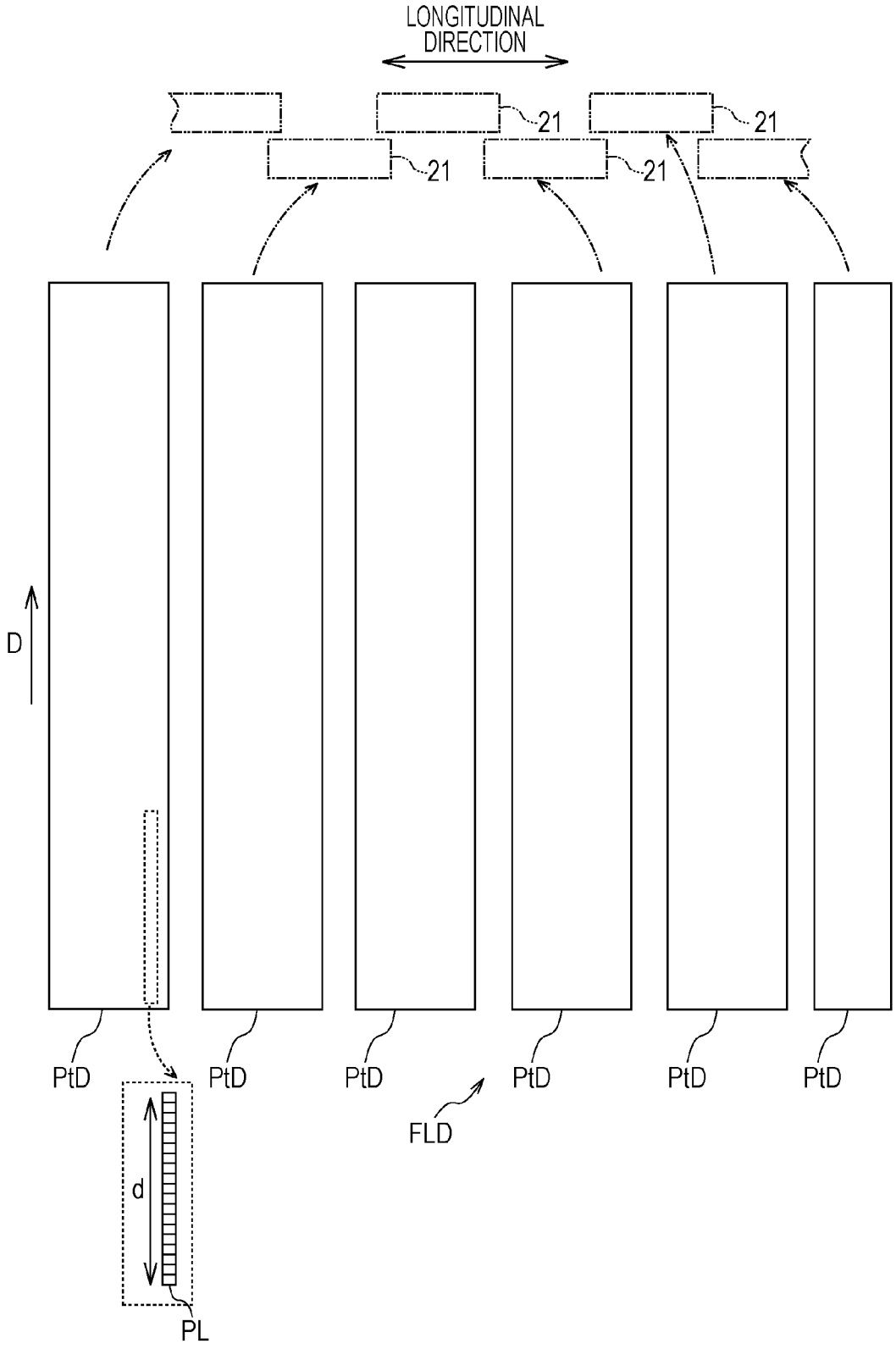
FIG. 5 is a diagram illustrating an example of flashing data in a simplified manner.

FIG. 5 illustrates flushing data FLD in a simplified manner. An arrow indicated by a letter "D" in FIG. 5 (as well as in FIG. 6) means a movement direction of data facing to the transport direction. The flushing data FLD is configured of a plurality of partial flushing data PtD each assigned to each of the heads 21 that constitute the line head. In FIG. 5 (and FIG. 6), the plurality of heads 21 are also illustrated so as to indicate the correspondence of the partial flushing data PtD to the heads 21. The partial flushing data PtD is a bundle of pixel rows. Further in FIG. 5, part of the partial flushing data PtD is exemplified in a range outlined by a dotted line. According to this example, part of one pixel row (PL) is illustrated. One pixel row is reproduced on a print medium by ink discharged through one single nozzle 22. When each of the partial flushing data PtD is assigned to each corresponding head 21, an end portion of one partial flushing data PtD assigned to one head 21 overlaps with an end portion of other partial flushing data PtD assigned to an adjacent head 21 in a direction orthogonally intersecting with the transport direction.

Figure 6:
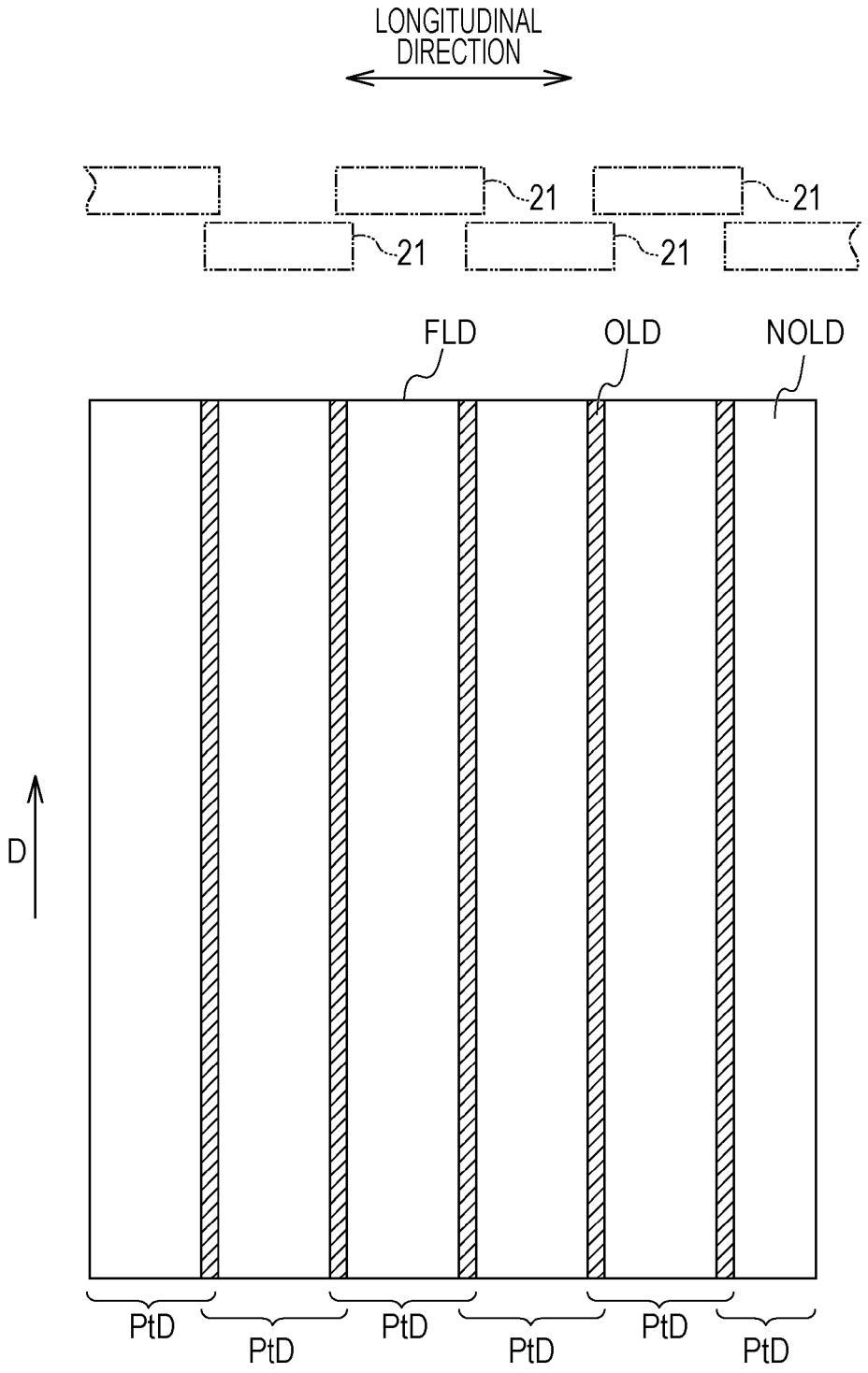
FIG. 6 is a diagram illustrating in a simplified manner an example of flushing data in a state in which partial flushing data are put together.

FIG. 6 illustrates an example of a state in which the partial flushing data PtD are put together with their positions being matched with the positions of the corresponding heads 21 in the longitudinal direction. In FIG. 6, an area where the end portions overlap each other in the above manner is exemplified as an overlap area data OLD (area indicated by slant lines in FIG. 6), and an area other than the overlap area data OLD is exemplified as a non-overlap area data NOLD. The overlap area data OLD is an image area onto which ink is discharged through the nozzles 22 that belong to the overlap area OLA in the respective line heads 20*a*, 20*b*, 20*c* and 20*d*. The non-overlap area data NOLD is an image area onto which ink is discharged through the nozzles 22 that do not belong to the overlap area OLA. As shown in FIG. 3, for example, in the case where the length in the longitudinal direction of one overlap area OLA is equivalent to four nozzles' worth of length, one overlap area data OLD corresponds to four pixel rows.

The print controller 12*a* creates the respective partial flushing data PtD so as to create the flushing data FLD. Here, an amount of ink to be discharged per set distance "d" within one pixel row defined by the partial flushing data PtD created in step S130 (for example, the number of pixels corresponding to an actual distance "d" as indicated in FIG. 5; the same applies hereafter) is taken as an ink amount M1. The ink amount M1 is a product of an ink amount per flushing dot and the number of times of dot-on of the flushing dots per set distance "d" within one pixel row defined by the partial flushing data PtD. The print controller 12*a* determines the dot patterns of the respective partial flushing data PtD (dot-on/off and a dot type in each pixel) so that the ink amounts M1 are the same in all pixel rows across all the partial flushing data PtD.

In this embodiment, a time when ink is discharged through a certain nozzle 22 for forming image formation dots or flushing dots is taken as a start point, a period of time from the start point in which clogging can possibly occur in the above nozzle is estimated, then such a time interval is set that prevents the occurrence of clogging, whereby the above set distance is calculated. Accordingly, the set distance can be also called a distance that a print medium or the printing head 20 moves at the time interval for forming flushing dots.

In a group of pixels corresponding to the overlap area data OLD of each of the partial flushing data PtD, the dot pattern may be determined so that the dot-on positions of flushing dots do not overlap the dot-positions thereof in a group of pixels corresponding to the overlap area data OLD of adjacent partial flushing data PtD. Since the positions of the nozzles 22 that belong to the overlap areas OLA in the line heads 20*a*, 20*b*, 20*c* and 20*d* are previously determined due to the structure of the printer 10, the print controller 12*a* can determine the dot patterns in the groups of pixels each corresponding to the overlap area data OLD in accordance with the above positional information. As a result, in a state in which the partial flushing data PtD are put together with their positions being matched with the positions of the corresponding heads 21 (FIG. 6), the ink amount to be discharged per set distance "d" within one pixel row in the overlap area data OLD is twice the ink amount M1 while the ink amount to be discharged per set distance "d" within one pixel row in the non-overlap area data NOLD is equal to the ink amount M1.

The print controller 12*a* creates the flushing data FLD for each ink type, and superimposes (combines) the print data representing the print target image and the flushing data FLD. Because the print data is configured of a plurality of partial data each corresponding to each of the heads 21 to which the partial data are assigned, the print controller 12*a* combines the flushing data FLD (partial flushing data PtD) and the print data (partial data of the print data) that correspond to the same head 21 of the same ink type, and obtains the combined data. Then, the print controller 12*a* executes a rasterizing process in which the combined data is rearranged in the order to be transferred to the printing head 20 (line heads 20*a*, 20*b*, 20*c* and 20*d*).

According to the rasterizing process, the following are determined for each individual dot defined in the post-combination data depending on a pixel position and color (ink type) of the dot: that is, through which of the nozzles 22, from which of the line heads 20*a*, 20*b*, 20*c* and 20*d*, and at what timing, the dot should be discharged and formed. In accordance with a result of the above process, ink is discharged from the printing head 20 (line heads 20*a*, 20*b*, 20*c* and 20*d*). The post-combination data is data configured to make each of the dots be formed on the print medium corresponding to each of the pixels which can obtain the dot-on information through logical addition in the combination result. Accordingly, the occurrence of clogging in the nozzles 22 can be prevented or removed simultaneously with the printing of the print target image. In the case where the print data representing the print target image is combined with the flushing data, such a dot can be called both an image formation dot and a flushing dot if the dot is formed on a print medium corresponding to a pixel whose dot-on information is defined in both the print data and the flushing data. In this respect, it can be stated that executing the above data combination processing varies the amount of flushing dots in accordance with the print target image. As described thus far, the first flushing is not such flushing that is performed on a transport belt (endless belt 16*d*) while the printing of a print target image being stopped temporarily (the same in a second flushing to be explained later), thereby largely contributing to the enhancement of throughput of the printing.

Meanwhile, in step S140, the print controller 12*a* executes the print process of the print target image including the "second flushing". When the second flushing is compared with the first flushing, it is common to both the first flushing and second flushing in that the flushing dots are formed on a print medium; however, the second flushing differs from the first one in that an ink amount discharged per set movement distance through each of the nozzles 22 is varied depending on the nozzles 22. More specifically, in the second flushing, an amount of ink discharged in the flushing per nozzle that does not belong to the overlap area OLA in a set movement distance is larger than an amount of ink discharged in the flushing per nozzle that belong to the overlap area OLA in a set movement distance. In step S140, the print controller 12*a* also creates flushing data FLD configured of a plurality of partial flushing data PtD as exemplified in FIG. 5.

Here, an amount of ink to be discharged per set distance "d" within one pixel row is taken as an ink amount M2, at the end portion of the partial flushing data Pt created in step S140 (a group of pixels corresponding to the overlap area data OLD when the partial flushing data PtD are put together). The ink amount M2 is a product of an ink amount per flushing dot and the number of times of dot-on of the flushing dots per set distance "d" within one pixel row at the end portion of one partial flushing data PtD. In addition, an amount of ink to be discharged per set distance "d" within one pixel row is taken as an ink amount M3, at an area other than the end portion of the partial flushing data PtD created in step S140 (a group of pixels corresponding to the non-overlap area data NOLD). The ink amount M3 is a product of an ink amount per flushing dot and the number of times of dot-on of the flushing dots per set distance "d" within one pixel row at the area other than the end portion of one partial flushing data PtD.

The print controller 12*a*, in step S140, determines the dot patterns of the respective partial flushing data PtD so that the ink amounts M2 and M3 satisfy a relation of M3>M2>M1. This is because a "specified condition" is satisfied in step S140. Because the clogging in the nozzles 22 is more likely to occur in a state in which the viscosity of ink in the nozzles 22 is further raised compared to a predetermined condition, much more flushing is needed in order to stabilize the behavior of the nozzles 22. Here, in this embodiment, the "specified condition" is defined as a case in which an amount of ink to be discharged in the flushing per nozzle 22 in a set movement distance is made equal to or greater than a predetermined ink amount threshold value (a case in which much more flushing is needed because clogging in the nozzles 22 is likely to occur). Accordingly, the print controller 12*a* makes the respective ink amounts M2 and M3 greater than the ink amount M1. Then, the print controller 12*a* makes the ink amount M3 greater than the ink amount M2 for a reason to be explained later.

The print controller 12*a* makes the setting of the number of times of dot-on of flushing dots and/or the setting of types of flushing dots (small dot, middle dot, large dot) differ between flushing data or between the above-discussed end portion and an area other than the end portion, thereby making it possible to produce predetermined differences in value among the ink amounts M1, M2 and M3. After the process in step S140, in a state in which the respective partial flushing data PtD are put together with their positions being matched to the positions of the corresponding heads 21 (FIG. 6), the amount of ink to be discharged per set distance "d" within one pixel row in the overlap area data OLD is twice the ink amount M2 while the amount of ink to be discharged per set distance "d" within one pixel row in the non-overlap area data NOLD is equal to the ink amount M3. Also in step S140, in a group of pixels corresponding to the overlap area data OLD of each of the partial flushing data PtD, the dot pattern may be determined so that the dot-on positions of flushing dots do not overlap the dot-on positions thereof in a group of pixels corresponding to the overlap area data OLD of adjacent partial flushing data PtD. A process after the creation of the flushing data FLD is the same as in step S130.

Figure 7:
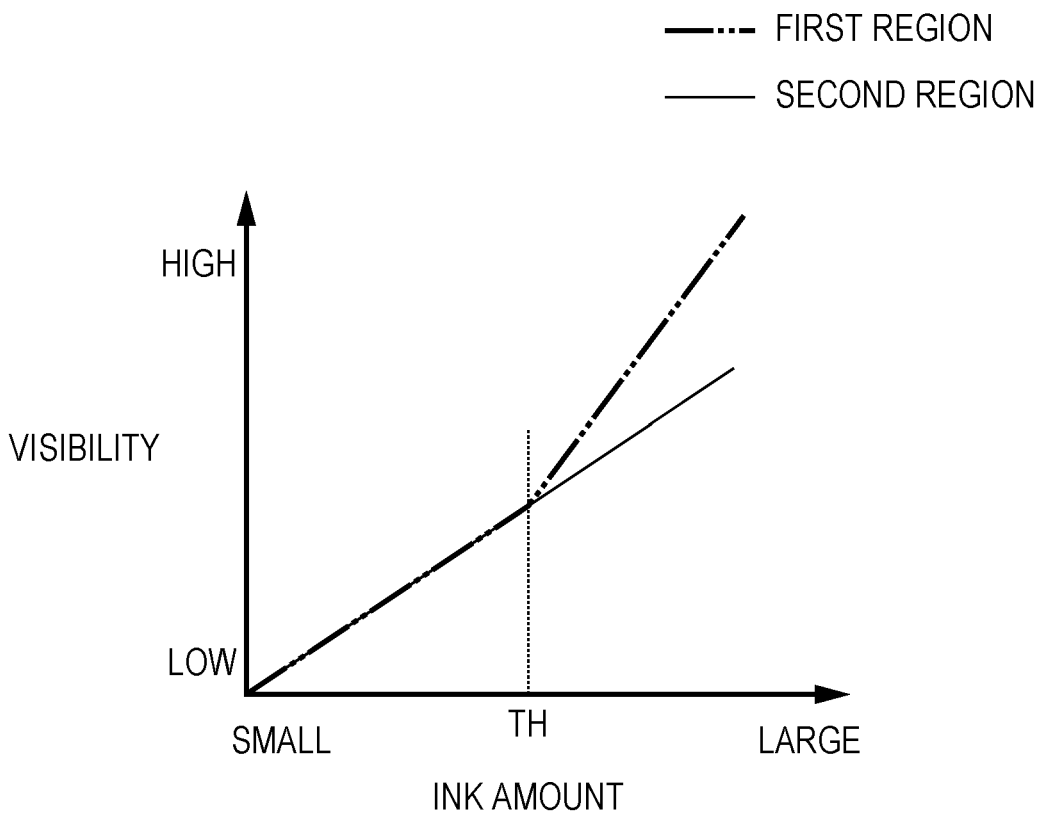
FIG. 7 is a diagram illustrating an example of a relationship between an ink amount and ink visibility.

FIG. 7 illustrates, using a graph, an example of a relationship between an ink amount discharged through a single nozzle 22 per set transport distance and visibility of the discharged ink (dot) on a print medium. To be more specific, visibility in a region on a print medium where printing is performed through the nozzle 22 that belongs to the overlap area OLA (first region) is exemplified by a double-dot dash line, and visibility in a region on the print medium where printing is performed through the nozzle 22 that does not belong to the overlap area OLA (second region) is exemplified by a sold line. Here, "visibility" means, for example, a digitized index of user's subjective evaluation, an index of noise that is calculated based on color measurement, a hue degree (brightness, for example), or the like. As shown in FIG. 3, in each of the overlap areas OLA of the line heads 20*a*, 20*b*, 20*c* and 20*d*, the number of nozzles 22 is twice the number of nozzles 22 in the area other than the overlap area OLA in the transport direction. Accordingly, in the first region, results of ink discharge carried out through two nozzles 22 in accordance with the data of pixel rows respectively assigned to the nozzles 22 are reproduced being superimposed; meanwhile, in the second region, a result of ink discharge carried out through a single nozzle 22 in accordance with the data of a pixel row assigned to the single nozzle 22 is reproduced.

Therefore, in the case where the amounts of ink discharged through the nozzles 22 are the same, in the first region, the amount of ink discharged on a line-shaped area, along the transport direction, having a width approximately equal to the diameter of the nozzle 22 is twice the amount of ink discharged in the second region. However, even if the discharged ink amount is doubled, it is not always the case that there arises a large difference in visibility. As shown in FIG. 7, when an ink amount discharged through a single nozzle is relatively smaller (in the case of the first flushing, for example), there is little difference in visibility even though the total amounts of discharged ink differ between the first region and the second region. Then, when the amount of ink discharged through the single nozzle becomes equal to or greater than a threshold value TH by gradually increasing the discharged ink amount, there arises a difference in visibility between the first and second regions (visibility in the first region is recognized much prominent), as shown in FIG. 7. Such a difference in visibility is recognized as stripe-shaped unevenness by a user who evaluates the printed result. In this embodiment, in the case where such a difference in visibility can be generated, the second flushing in which the ink amount M3 is made larger than the ink amount M2 (for example, the ink amount M3 is approximately twice the ink amount M2) is executed so that the difference in visibility is removed (or lessened). In other words, the "specified condition" can be expressed as a state in which a larger amount of ink (equal to or greater than the threshold value TH) need be discharged as flushing through the nozzles 22 such that a larger difference in the visibility is generated beyond a predetermined level of degree. The threshold value TH also indicates a value of the ink amount discharged per set distance "d" within one pixel row, and a relation of M3>M2≥TH>M1 is satisfied between the threshold value TH and the ink amounts M1, M2 and M3.

The "specified condition" will be explained in detail below. The temperature/humidity sensor 17 shown in FIG. 1 (an example of a temperature/humidity sensor in the aspects of the invention) detects an ambient temperature and/or humidity in the vicinity of the printing head 20. A case in which the ambient temperature in the vicinity of the printing head 20 is equal to or higher than a predetermined temperature threshold value and a case in which the ambient humidity in the vicinity of the recording head 20 is equal to or less than a predetermined humidity threshold value, indicate that the viscosity of ink in the nozzles 22 is more likely to increase than in an environment under predetermined conditions as standard levels (lower temperature than the temperature threshold value and/or higher humidity than the humidity threshold value). In this case, in order to prevent the nozzles 22 from being clogged, an amount of ink discharged as flushing through a single nozzle 22 per set transport distance is set to be at least equal to or greater than the threshold value TH (FIG. 7).

The print controller 12*a* acquires a detection result by the temperature/humidity detector 17. Then, for example, if the detected temperature is equal to or greater than the temperature threshold value or the detected humidity is equal to or less than the humidity threshold value, it is determined in step S120 that "the specified condition is satisfied (Yes)" and the process proceeds to step S140. Alternatively, in the case where the detected temperature is equal to or greater than the temperature threshold value and the detected humidity is equal to or less than the humidity threshold value, it may be determined in step S120 that "the specified condition is satisfied (Yes)" and the process may proceed to step S140. As a result, in the case where the viscosity of ink in the nozzles 22 is more likely to increase (a state in which much more flushing is needed) than in a regular state because of the ambient temperature in the vicinity of the nozzles 22 being relatively higher or the ambient humidity in the vicinity thereof being relatively lower, the printer 10 can execute necessary and sufficient flushing through each of the nozzles 22 and suppress the generation of stripe-shaped unevenness (image quality deterioration) as described above on the print medium.

In addition, in step S120, as an example of the "specified condition", a case that "a humidification function of a humidified air supplier 18*b* has declined below a predetermined standard level" may be employed. The humidification maintenance unit 18 includes a humidification liquid tank 18*a* for storing a humidification liquid containing a nonvolatile component, the humidified air supplier 18*b* configured to supply the air humidified by the humidification liquid stored in the humidification liquid tank 18*a* to a sealed space opposing the openings of the nozzles 22, and so on (see FIG. 1), so as to suppress an increase in viscosity of ink in the nozzles 22. As for details of the configuration of the humidification maintenance unit 18, a humidification mechanism described in JP-A-2012-158070 should be referred to as needed. When a remaining amount of the humidification liquid (water) stored in the humidification liquid tank 18*a* becomes smaller, the humidification liquid tank 18*a* is replenished with water. A preservative agent is added in the water replenished to the tank in order to prevent the water from going septic. Since the preservative agent contains a nonvolatile component, the concentration of the nonvolatile component within the humidification liquid tank 18*a* becomes higher as the evaporation and the replenishing of the water are repeated.

In the case where the concentration of the nonvolatile component becomes higher, a vapor generation function in the humidification liquid tank 18*a* declines, and consequently the humidification function of the humidified air supplier 18*b* (a function to suppress an increase in viscosity of ink in the nozzles 22) declines. In this case, it is necessary to set an amount of ink discharged as flushing through a single nozzle 22 per set transport distance to be at least equal to or greater than the threshold value TH (FIG. 7) in order to prevent the nozzles 22 from being clogged. Then, the print controller 12*a* determines whether or not the amount of the nonvolatile component in the water stored in the humidification liquid tank 18*a* is equal to or greater than a defined value that has been previously determined and set. In the case where the amount of the nonvolatile component is equal to or greater than the defined value, it is considered that the humidification function of the humidified air supplier 18*b* has declined below the standard level, the determination "Yes" is taken in step 120, and then the process proceeds to step S140. As for a method of determining whether or not the amount of the nonvolatile component contained in the water is equal to or greater than the define value, a method described in JP-A-2012-158070 should be referred to as needed. As a result, in the case where the viscosity of ink in the nozzles 22 is more likely to increase (a state in which much more flushing is needed) than in a regular state because of the humidification function of the humidified air supplier 18*b* having declined below the standard level, the printer 10 can execute necessary and sufficient flushing through each of the nozzles 22 and suppress the generation of stripe-shaped unevenness (image quality deterioration) as described above on the print medium.

3. Variations

The invention is not limited to the above embodiment, and can be implemented in various kinds of modes without departing from the scope and spirit of the invention. For example, the following variations can be made. Any contents in which the above embodiment and part of or all of the variations are combined are also within the disclosed range of this invention.

First Variation

The printer 10 may use a first ink and a second ink. The second ink has a higher viscosity than the first ink, or is more likely to thicken than the first ink even in the same environment. The printer 10 discharges the first ink and the second ink respectively through different line heads. With the above configuration, in the printer 10, the line head configured to discharge the first ink may execute the first flushing along with the printing of a print target image while the line head configured to discharge the second ink may execute the second flushing along with the printing of the print target image. In other words, when the print controller 12*a* transfers the print data, at the time of printing the print target image, to the line head configured to discharge the second ink, it is assumed that such a specified condition (use of the second ink) is satisfied that increases the viscosity of ink in the nozzles 22 in comparison with a predetermined condition (use of the first ink). Then, the print controller 12*a* causes the line head configured to discharge the second ink to execute the printing of the print target image in accordance with the combined data of the print data corresponding to the second ink and the flushing data FLD, and execute the second flushing.

Second Variation

A method for implementing the flushing is not limited to the method that combines print data and flushing data. For example, the print controller 12*a* does not create flushing data, and instead supplies the printing head 20 with driving signals (signals not related to a print target image) such as the one in pulse waveforms to make flushing dots be discharged through the nozzles 22. At this time, in the case of the first flushing, the driving signals basically having the same waveform (such a waveform that produces the ink amount M1) are supplied to the piezoelectric elements of the respective nozzles 22 (phases are shifted for each of the nozzles 22). Meanwhile, in the case of the second flushing, the driving signals having different wave forms (such a waveform that produces the ink amount M2 or such a waveform that produces the ink amount M3), depending on whether or not the nozzles 22 belong to the overlap area OLA, are supplied to the piezoelectric elements of the respective nozzles 22 (phases are shifted for each of the nozzles 22). The flushing control process can be also implemented using the above configuration. In the second variation, flushing dots are superimposed and formed on the positions where image formation dots are formed in some case. That is, unlike the above-discussed case in which print data and flushing data are combined, the amount of flushing dots is not varied in accordance with the print target image.

Third Variation

As another method for implementing the flushing, the print controller 12*a* may create such print data that generates image formation dots and flushing dots when executing the halftone processing. The "print data" in the third variation, unlike the print data having been discussed so far, does not represent only a print target image. In the third variation, for example, dither masks to be used in the halftone processing are prepared beforehand for the first flushing and the second flushing, respectively. For example, the dither mask for the first flushing is a dither mask in which a minimum threshold value of 0 is designated in all the pixel rows at a frequency to realize the ink amount M1 in addition to a typical threshold value being designated. Further, for example, the dither mask for the second flushing is a dither mask in which the minimum threshold value of 0 is designated in the pixel rows assigned to the respective nozzles 22 that belong to the overlap area OLA at a frequency to realize the ink amount M2, and in addition the minimum threshold value of 0 is designated in the pixel rows assigned to the respective nozzles 22 that do not belong to the overlap area OLA at a frequency to realize the ink amount M3, in addition to the typical threshold value being designated. The threshold value in the dither mask is compared with a tone value of each pixel of ink amount data before the halftone processing so as to assign the dot-on or the dot-off; if the value thereof is the minimum threshold value of 0, it means that the dot-on is assigned with certainty. Accordingly, by executing the halftone processing using the dither mask, such print data that generates image formation dots and flushing dots is created. In the third variation, it is unnecessary to create flushing data, and only by executing printing based on the print data, image formation dots and flushing dots are formed on a print medium.

Fourth Variation

Figure 8:
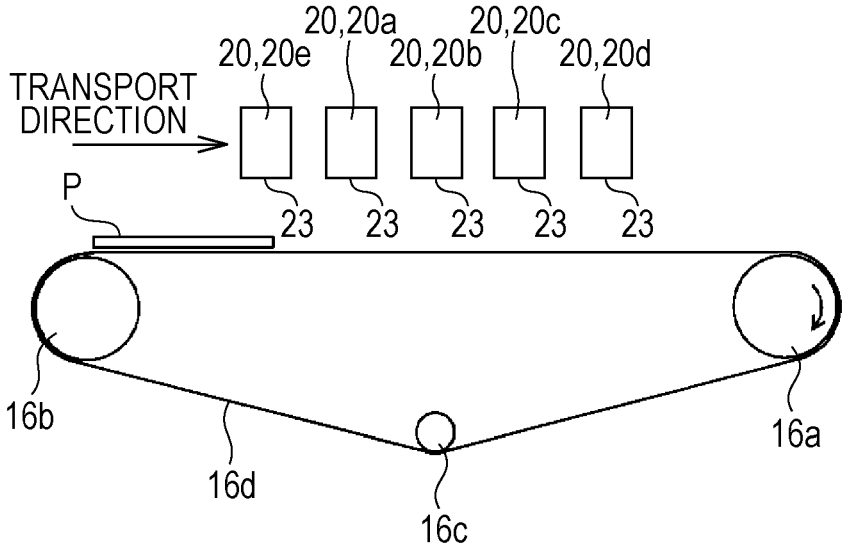
FIG. 8 is a diagram illustrating in a simplified manner an example of part of the internal configuration of a printer according to a variation.

FIG. 8 illustrates in a simplified manner an example of part of the internal configuration of the printer 10 from a point of view facing to the longitudinal direction of the printing head 20. FIG. 8 differs from FIG. 2 in that a line head 20*e* is additionally provided. The line head 20*e* is disposed on the upstream side from the line heads 20*a*, 20*b*, 20*c* and 20*d* in the transport direction, and the configuration thereof is the same as those of the line heads 20*a*, 20*b*, 20*c* and 20*d*. The line head 20*e* is a printing head configured to discharge a precoat liquid through the nozzles 22. The precoat liquid is discharged onto a print medium P before the inks of CMYK are discharged onto the print medium P; thereafter the precoat liquid contributes to the protection of bleeding of ink that has landed on the precoat liquid and to the enhancement of coloring of the ink. JP-A-2012-153151 should be referred to as needed regarding explanation of the precoat liquid or the like.

In the fourth variation, the inks of CMYK each correspond to the first liquid for forming an image on a print medium according to the aspects of the invention. The line heads 20*a*, 20*b*, 20*c* and 20*d* correspond to the first head unit; the plurality of heads 21 configuring the line heads 20*a*, 20*b*, 20*c* and 20*d* correspond the first heads; and the plurality of nozzles 22 included in the head units 21 configuring the line heads 20*a*, 20*b*, 20*c* and 20*d* correspond to the first nozzles. Further, the precoat liquid corresponds to the second liquid; the line head 20*e* corresponds to the second head unit; and the plurality of nozzles 22 included in the line head 20*e* correspond to the second nozzles. Furthermore, the print controller 12*a* corresponds to the control unit that controls the first head unit (line heads 20*a*, 20*b*, 20*c* and 20*d*) and the second head unit (line head 20*e*), makes the ink be discharged through the nozzles 22 included in the line heads 20*a*, 20*b*, 20*c* and 20*d*, and makes the precoat liquid be discharged through the nozzles 22 included in the line head 20*e*.

Figure 9:
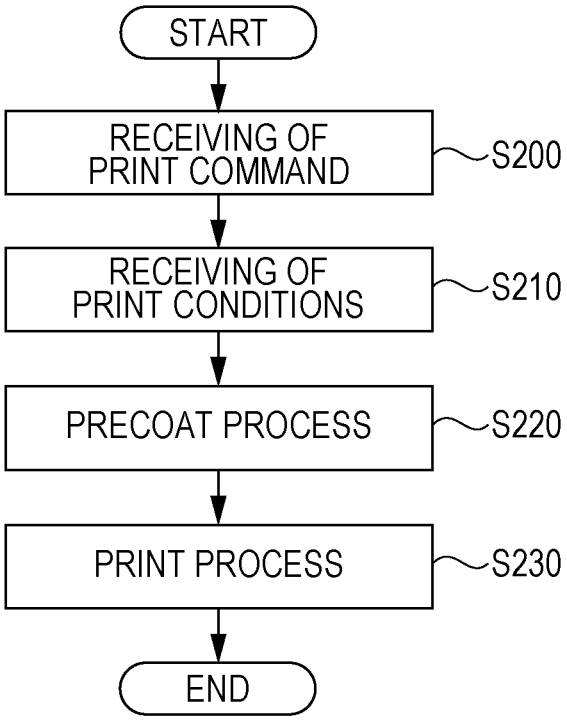
FIG. 9 is a flowchart according to a variation.

FIG. 9 illustrates, using a flowchart, a print control process according to the fourth variation. Steps S200 and S210 in this print control process are the same as steps S100 and S110. Since the print process of a print target image (step S230) has already been explained, description thereof is omitted. In step S220, the print controller 12*a* creates precoat data PrD to make the line head 20*e* discharge the precoat liquid, and executes a precoat process based on the precoat data PrD. In this case, the print controller 12*a* causes an amount of the precoat liquid discharged per unit area through the nozzles 22 included in the line head 20*e* onto an area on the print medium (first region) where ink is discharged through the nozzles 22 belonging to the overlap area OLA in the line heads 20*a*, 20*b*, 20*c* and 20*d* to be smaller than an amount of the precoat liquid discharged per unit area through the nozzles 22 included in the line head 22*e* onto an area on the print medium (second region) where ink is discharged through the nozzles 22 not belonging to the overlap area OLA in the line heads 20*a*, 20*b*, 20*c* and 20*d*.

Figure 10:
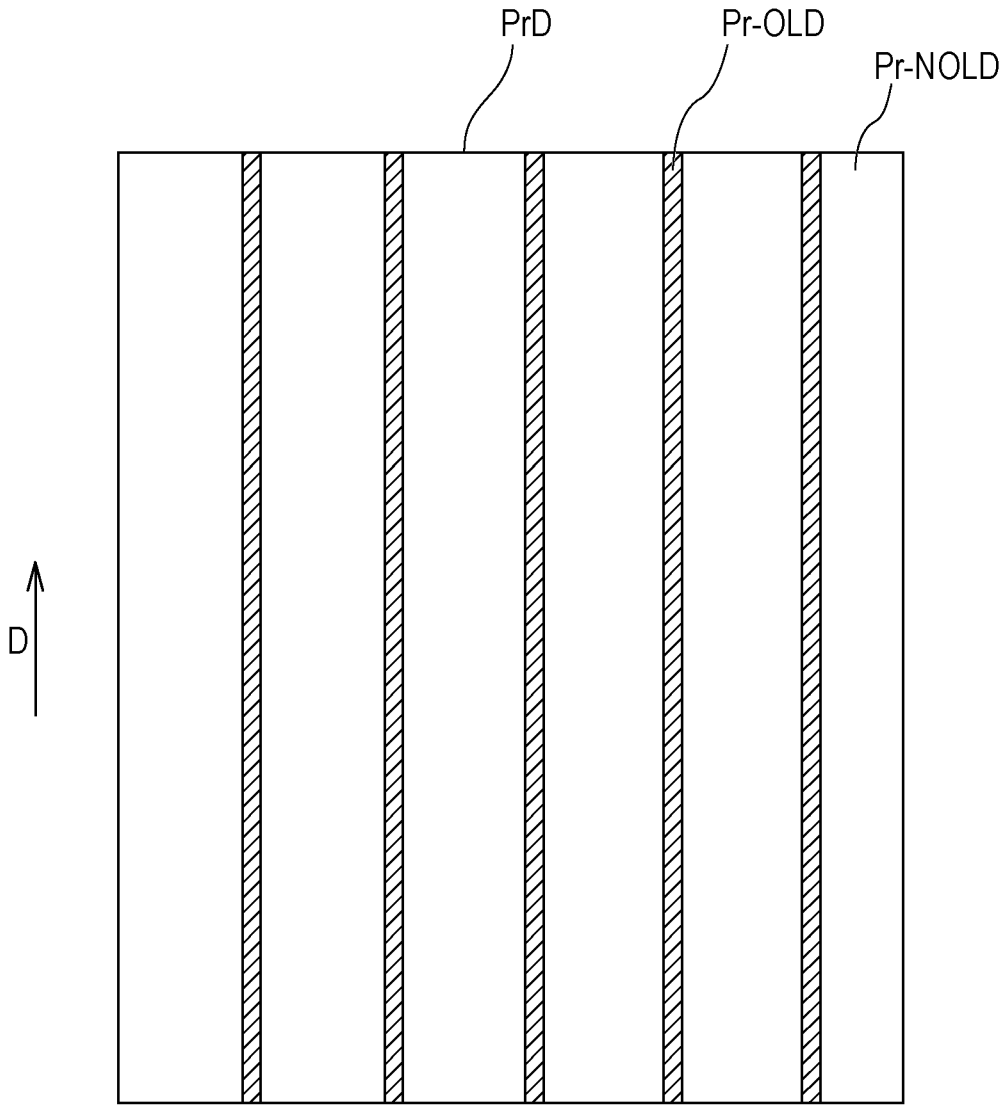
FIG. 10 is a diagram illustrating an example of precoat data in a simplified manner.

FIG. 10 illustrates an example of the precoat data PrD created in step 220 in a simplified manner. An arrow indicated by a letter "D" means a direction of data facing to the transport direction. The precoat data PrD includes overlap area data Pr-OLD disposed in the same arrangement as the overlap area data OLD shown in FIG. 6, and also includes non-overlap area data Pr-NOLD disposed in the same arrangement as the non-overlap area data NOLD shown in FIG. 6. The overlap area data Pr-OLD is an image area onto which the precoat liquid is discharged through the nozzles 22 belonging to the overlap area OLA in the line head 20*e*. The non-overlap area data Pr-NOLD is an image area onto which the precoat liquid is discharged through the nozzles 22 not belonging to the overlap area OLA in the line head 20*e*.

The print controller 12*a* determines the dot patterns of the overlap area data Pr-OLD and the non-overlap area data Pr-NOLD so as to create the precoat data PrD. In this case, the print controller 12*a*, for example, sets a dot-on rate per unit area within the overlap area data Pr-OLD to be smaller than a dot-on rate per unit area within the non-overlap area data Pr-NOLD, and creates the precoat data PrD. Further, the print controller 12*a* may set a dot type within the overlap area data Pr-OLD to be a type having a smaller ink amount (for example, a small dot) than a dot type within the non-overlap area data Pr-NOLD (for example, a middle dot). The print controller 12*a* transfers the created precoat data PrD to the line head 20*e*. As for the overlap area data Pr-OLD, for example, half of the data of pixels configuring the overlap area data Pr-OLD is assigned to the nozzles 22 included in one head 21 from among the nozzles 22 that belong to the overlap area OLA to which the overlap area data Pr-OLD is assigned, and the other half of the data of pixels is assigned to the nozzles 22 included in the other head 21 from among the nozzles 22 that belong to the overlap area OLA to which the overlap area data Pr-OLD is assigned. Through this, dots of the precoat liquid are formed on a print medium in accordance with the dot patterns defined by the precoat data PrD before the print process being executed.

In this case, the amount of the precoat liquid discharged per unit area onto the first region is smaller than the amount of the precoat liquid discharged per unit area onto the second region. Accordingly, when the inks of CMYK are discharged onto the precoat liquid in the print process (step S230) after the precoat process, the first region is less capable of protecting the bleeding of ink and enhancing the coloring of ink than the second region. However, in the first region, since the number of nozzles 22 for printing one pixel row is twice the number thereof in the second region, the amount of ink discharged per unit area is larger than that in the second region. In other words, in the first region, because it is intended to protect the bleeding of and to enhance the coloring of the ink whose amount discharged per unit area is larger than in the second region by using the precoat liquid whose amount discharged per unit area is smaller than in the second region, the coloring is not enhanced despite the large amount of ink and consequently there arises little difference in coloring between the first region and the second region. That is, a difference in degree of coloring of ink, a difference in degree of bleeding of ink, and the like between the first and second regions are removed, whereby it is possible with certainty to protect the deterioration in image quality that can possibly occur due to the presence of the above-described connecting portions.

Fifth Variation

It has been usually carried out to previously discharge a precoat liquid to an area on a print medium where a print target image is to be printed. However, as described above, flushing dots, in addition to image formation dots that represent a print target image, are formed on the print medium. Therefore, the print controller 12*a* makes the line head 20*e* discharge the precoat liquid onto the positions where the flushing dots are formed. As a method to be used in this case, a number of methods can be considered as follows.

First Method: the precoat liquid is previously discharged on the positions that are the same as those where the flushing dots are formed, corresponding to each of the flushing dots. The print controller 12*a* can determine the positions of the flushing dots on the print medium by referring to the flushing data, the driving signal waveforms in the second variation, the print data in the third variation, or the like. Since the actual forming positions of the flushing dots can be shifted, the print controller 12*a* may cause the line head 20*e* to discharge the precoat liquid to the positions where the flushing dots are to be formed and the peripheral areas including the positions.

Second Method: the print controller 12*a* determines whether or not one or more flushing dots are formed in a unit of raster in parallel to the longitudinal direction; if one or more flushing dots are formed in the above raster, the print controller 12*a* makes the precoat liquid be discharged to the whole raster. However, the precoat liquid may be discharged not to the whole raster, but only to a partial range of the raster including the position where the flushing dots are formed.

Third Method: the print controller 12*a* makes the precoat liquid be discharged beforehand to all areas where no image forming dots are present on the print medium. In other words, whether flushing dots are present or not, the precoat liquid may be discharged to a range other than the range where image formation dots are present.

Moreover, it is possible for the printer 10 to execute flushing with regard to the precoat liquid. In other words, in order to prevent the nozzles 22 of the line head 20*e* from being clogged, a set amount of the precoat liquid is discharged periodically through the nozzles 22 of the line head 20*e*, for example. In this case, because the precoat liquid is transparent, the discharged liquid itself will not be visually recognized by a user. Accordingly, in the case where the print controller 12*a* controls the line head 20*e* to execute the flushing regarding the nozzles 22 thereof, it is unnecessary to execute the flushing control process (the process in which the flushing amount is varied depending on the nozzles 22), which is executed in the case of the ink as described above.

Sixth Variation

The processes shown in FIGS. 4 and 9, and the processes executed on the printer 10 side may be executed on the PC 40 side. In other words, the printer driver 41 may execute the processes in steps S100 and S110, and in steps S200 and S210, and execute the determination process in step S120 in accordance with the program; moreover, the printer driver 41 may instruct the printer 10 to execute the creation processes of print data, flushing data, precoat data, and so on, execute any one of the processes in steps S130 and S140 based on a determination result in the determination process, execute the precoat process, execute the process in step 230, and so on.

Liquids to which the flushing described in this specification can be executed include any type of liquid or fluid, aside from ink, as long as the viscosity thereof can be changed due to evaporation of its moisture, a solvent, or the like.

The entire disclosure of Japanese Patent Application No. 2012-262118, filed Nov. 30, 2012 is expressly incorporated by reference herein.

What is claimed is:

1. A printing apparatus capable of forming image formation dots on a print medium to print an image specified as a print target, comprising:

a head unit in which disposed are a plurality of heads aligned in a particular direction, each of the plurality of heads including a plurality of nozzles aligned in at least one nozzle row extending in the particular direction, the plurality of heads being disposed so that the at least one nozzle row of each head partially overlaps the at least one nozzle row of each adjacent head, each head having overlapping nozzles and non-overlapping nozzles; and a control unit configured to make the head unit execute a specified operation for forming flushing dots other than the image formation dots on the print medium, wherein the control unit makes the head unit execute the specified operation such that a liquid amount discharged per non-overlapping discharging nozzle is larger than a liquid amount discharged per overlapping discharging nozzle, in a case where a specified condition for execution of the specified operation is satisfied.

2. The printing apparatus according to claim 1, wherein the control unit determines that the specified condition is satisfied in the case where a liquid amount discharged in the specified operation per nozzle is to be equal to or greater than a predetermined threshold value.

3. The printing apparatus according to claim 1, further comprising:

a temperature/humidity detector configured to detect an ambient temperature or humidity, wherein the control unit determines that the specified condition is satisfied in the case where the temperature/humidity detector has detected a temperature value equal to or greater than a predetermined temperature threshold value or a value of humidity equal to or less than a predetermined humidity threshold value.

4. The printing apparatus according to claim 1, further comprising:

a humidification liquid tank for storing a humidification liquid containing a nonvolatile component; and a humidified air supplier for supplying a humidified air having been humidified by the humidification liquid stored in the humidification liquid tank to a sealed space that opposes an opening of the nozzle, wherein the control unit determines that the specified condition is satisfied in the case where a humidification function of the humidified air supplier has declined below a predetermined standard level.

5. The printing apparatus according to claim 4, wherein the control unit judges whether or not an amount of the nonvolatile component in the humidification liquid that is stored in the humidification liquid tank is equal to or greater than a defined value, and determines that the humidification function of the humidified air supplier has declined below the predetermined standard level in the case where the amount of the nonvolatile component is equal to or greater than the defined value.

6. A printing method of carrying out printing by using a printing apparatus that is capable of forming image formation dots on a print medium to print an image specified as a print target, wherein the printing apparatus includes a head unit in which disposed are a plurality of heads aligned in a particular direction, each of the plurality of heads including a plurality of nozzles aligned in at least one nozzle row extending in the particular direction, the plurality of heads being disposed so that the at least one nozzle row of each head partially overlaps the at least one nozzle row of each adjacent head, each head having overlapping nozzles and non-overlapping nozzles, the method comprising, when making the head unit execute a specified operation for forming flushing dots other than the image formation dots on the print medium, causing the specified operation to be executed if a specified condition for execution of the specified operation is satisfied, so that, in the specified operation, a liquid amount discharged per non-overlapping discharging nozzle is larger than a liquid amount discharged per overlapping discharging nozzle.

* * * * *